US010803774B2

(12) United States Patent
Zhang et al.

(10) Patent No.: US 10,803,774 B2
(45) Date of Patent: Oct. 13, 2020

(54) DISPLAY DEVICE

(71) Applicant: BOE Technology Group Co., Ltd., Beijing (CN)

(72) Inventors: Bao Zhang, Beijing (CN); Zhiguo Shen, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 98 days.

(21) Appl. No.: 16/129,220

(22) Filed: Sep. 12, 2018

(65) Prior Publication Data

US 2019/0122591 A1 Apr. 25, 2019

(30) Foreign Application Priority Data

Oct. 20, 2017 (CN) ..... 2017 2 1358483 U

(51) Int. Cl.
*G09F 7/18* (2006.01)

(52) U.S. Cl.
CPC ..... *G09F 7/18* (2013.01); *G09F 2007/186* (2013.01); *G09F 2007/1865* (2013.01)

(58) Field of Classification Search
None
See application file for complete search history.

(56) References Cited

U.S. PATENT DOCUMENTS 1,840,915 A * 1/1932 Palmer ..... G09F 7/18 40/557
1,918,570 A * 7/1933 Morris ..... G09F 7/18 40/607.12
2,316,539 A * 4/1943 Patterson ..... G09F 7/18 40/557
2,519,928 A * 8/1950 Pfaff, Jr. ..... G09F 7/18 40/607.01
2,625,762 A * 1/1953 McColl ..... G09F 23/00 40/607.03
3,984,931 A * 10/1976 Belokin, Jr. ..... G09F 7/08 40/559
4,528,764 A * 7/1985 Cobb ..... G09F 13/04 40/553
4,856,216 A * 8/1989 Gross ..... G09F 13/04 40/559
4,947,570 A * 8/1990 May ..... G09F 13/08 40/553
5,025,355 A * 6/1991 Harwood ..... F21S 8/06 362/147

(Continued)

*Primary Examiner* — David R Dunn
*Assistant Examiner* — Christopher E Veraa
(74) *Attorney, Agent, or Firm* — Arent Fox LLP; Michael Fainberg

(57) ABSTRACT

The disclosure relates to the field of display technologies and discloses a display device. The display device comprises a first display screen and a second display screen arranged at a certain included angle back to back, wherein the first display screen is provided with a first front frame, the second display screen is provided with a second front frame, and a bottom border of the first front frame is spliced with a bottom border of the second front frame; wherein the bottom border of the first front frame is provided with a first positioning boss, the bottom border of the second front frame is provided with a first positioning stud, and the first positioning boss matches with the first positioning stud by plugging.

15 Claims, 4 Drawing Sheets

(56) References Cited

U.S. PATENT DOCUMENTS

| | | | | |
|---|---|---|---|---|
| 5,282,331 | A * | 2/1994 | Fell | G09F 7/22<br>362/223 |
| 5,355,604 | A * | 10/1994 | Rathke | G09F 7/18<br>160/24 |
| 5,560,131 | A * | 10/1996 | Gibson | G09F 7/20<br>40/607.12 |
| 7,845,103 | B2 * | 12/2010 | Logan | G09F 7/18<br>24/573.09 |
| 2004/0257803 | A1 * | 12/2004 | Kermoade | G09F 7/18<br>362/223 |
| 2005/0166435 | A1 * | 8/2005 | Lackey | G09F 7/18<br>40/617 |
| 2011/0061275 | A1 * | 3/2011 | Ginebra Giudicelli | G09F 13/0413<br>40/572 |

* cited by examiner

DISPLAY DEVICE

CROSS-REFERENCE TO RELATED APPLICATION

This application claims priority of Chinese Patent Application No. 201721358483.8, filed on Oct. 20, 2017, which is hereby incorporated by reference in its entirety.

FIELD

The disclosure relates to the field of display technologies, and particularly to a display device.

BACKGROUND

The vehicle-carried display device is an important component on the urban bus and rail car, and has become the standard accessory of the public entertainment service system gradually. In the carriage of the rail car and especially train, in order to facilitate viewing by the passenger inside the car, the hoisting display structure is commonly used, that is, two displays are spliced into one piece at a certain angle back to back, their display pictures tilt down, and the displays are fixed to the car roof by the mounting bracket in entirety. Due to the hoisting special structure, the two displays need to be spliced at a certain angle, which proposes a higher requirement for the positioning and splicing precision of the displays.

BRIEF SUMMARY

The disclosure provides the following technical solutions.

A display device, comprising a first display screen and a second display screen arranged at a certain included angle back to back, wherein the first display screen is provided with a first front frame, the second display screen is provided with a second front frame, and a bottom border of the first front frame is spliced with a bottom border of the second front frame; wherein:

the bottom border of the first front frame is provided with a first positioning boss, the bottom border of the second front frame is provided with a first positioning stud, and the first positioning boss matches with the first positioning stud by plugging.

Optionally, the first positioning boss is provided inside the first front frame; and the first positioning stud is provided inside the second front frame.

Optionally, the first positioning stud is a cuboid and includes a top surface far from a bottom border surface of the second front frame, two first lateral surfaces arranged along an extending direction of the bottom border of the second front frame, and a second lateral surface close to a bottom side of the bottom border of the second front frame.

Optionally, the first positioning boss includes an inner blocking surface for correspondingly contacting a top surface of the first positioning stud, a lateral blocking surface for correspondingly contacting one of first lateral surfaces of the first positioning stud, and a lap joint surface for correspondingly contacting a second lateral surface of the first positioning stud.

Optionally, the bottom border of the second front frame is provided with a second positioning boss, the bottom border of the first front frame is provided with a second positioning stud, and the second positioning boss matches with the second positioning stud by plugging.

Optionally, the first positioning boss and the second positioning stud are arranged symmetrically with respect to a center line of the first front frame; and the second positioning boss and the first positioning stud are arranged symmetrically with respect to a center line of the second front frame.

Optionally, the structures of the first and second front frames are same.

Optionally, the first and second front frames are molded by a mould.

Optionally, the display device further includes a triangular fixed mount which is located between the first and second display screens and fixedly connected with the first and second display screens respectively.

Optionally, the triangular fixed mount is provided with a first fixed edge parallel to a back panel of the first display screen and a second fixed edge parallel to a back panel of the second display screen; the back panel of the first display screen is fixed to the first fixed edge by a fastener; and the back panel of the second display screen is fixed to the second fixed edge by a fastener.

DETAILED DESCRIPTION OF THE EMBODIMENTS

Figure 1:
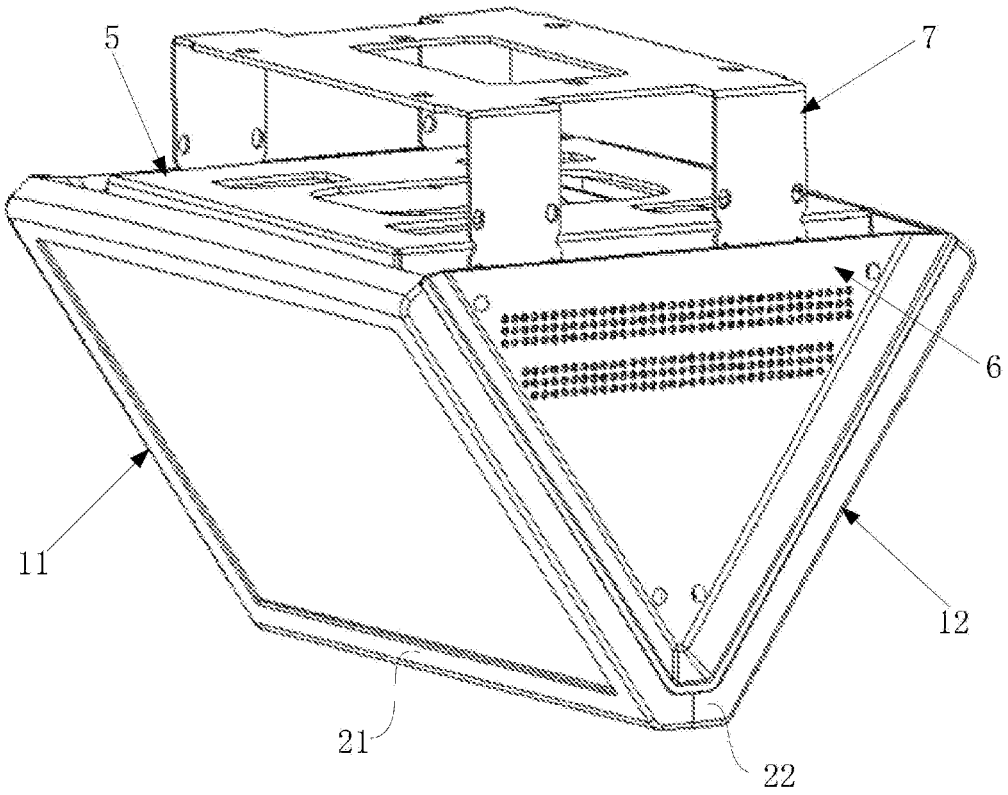
FIG. 1 is a structural schematic diagram of a display device provided by an embodiment of the disclosure.

At present, the splicing of the existing hoisting displays is mainly implemented by the triangular fixed mount between two displays, that is, the two displays are fixed on two fixed edges of the triangular fixed mount respectively. Since the two fixed edges of the triangular fixed mount has a certain angle, the size error appears very easily during the machining process, to thereby cause the phenomenon of splicing misalignment of the two displays fixed thereon in the up and down or left and right directions. Thus the existing hoisting display has poorer splicing precision and low splicing efficiency.

The technical solutions in the embodiments of the disclosure will be described clearly and completely below in combination with the accompanying drawings in the embodiments of the disclosure. Obviously the described embodiments are only a part of the embodiments of the disclosure but not all the embodiments. Based upon the embodiments of the disclosure, all of other embodiments obtained by those ordinary skilled in the art without creative work pertain to the protection scope of the disclosure.

As shown in FIGS. 1 to 4, the embodiments of the disclosure provide a display device, which includes a first display screen and a second display screen arranged at a certain included angle back to back, where the first display screen is provided with a first front frame 11, the second display screen is provided with a second front frame 12, and the bottom border 21 of the first front frame 11 is spliced with the bottom border 22 of the second front frame 12.

The bottom border 21 of the first front frame 11 is provided with a first positioning boss 30, the bottom border 22 of the second front frame 12 is provided with a first positioning stud 40, and the first positioning boss 30 matches with the first positioning stud 40 by plugging.

For the above-mentioned display device, when the two display screens are spliced, the first positioning stud 40 can firstly be plugged into the first positioning boss 30 to thereby implement the mutual limit of the two front frames and avoid the occurrence of the misalignment of the two display screens, and then the two display screens are fastened fixedly to the triangular fixed mount 5; thus the splicing and positioning precision of two display screen structures can be increased greatly to ensure the product appearance, while the continuous alignment and adjustment actions due to the misalignment of the two display screens in the installation process can also be avoided and then the installation efficiency of the product can be increased greatly.

In conclusion, the above-mentioned display device can increase the splicing and positioning precision and installation efficiency of the hoisting display device effectively.

As shown in FIGS. 1 to 4, in an optional embodiment, the first positioning boss 30 is provided on an inner side facing to the first display screen, of the first front frame 11; and the first positioning stud 40 is provided on an inner side facing to the second display screen, of the second front frame 12; that is, each of the first positioning boss 30 and the first positioning stud 40 is arranged at the side of the front frame structure towards the display module. On the one hand, the inner sides of the first front frame 11 and the second front frame 12 are arranged opposite to each other, so the structure of the positioning boss 3 and the positioning stud 4 is formed on inner sides of the two front frames, which is easier to implement the plugging arrangement; and on the other hand, the inner side of the front frame is the side of its draft direction, where the positioning boss 3 and the positioning stud 4 are arranged at this side and can have the same draft direction as the front frame, to thereby facilitate the molding by the mould.

Figure 4:
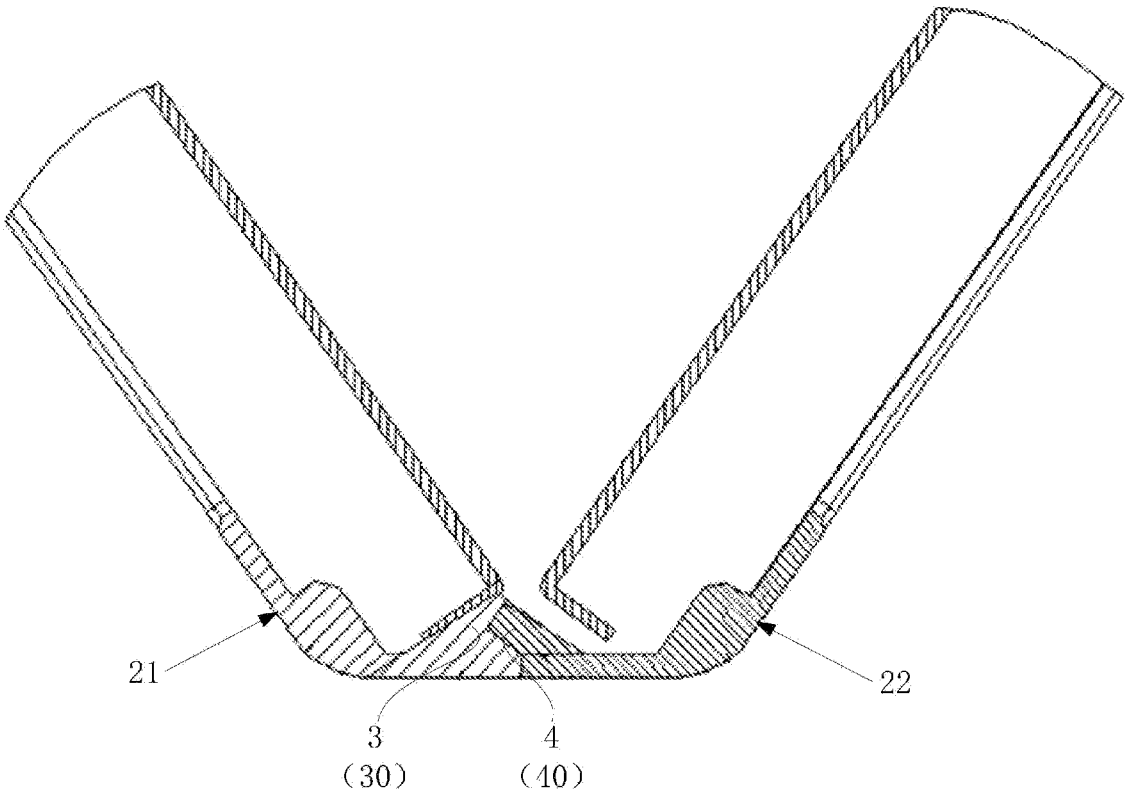
FIG. 4 is a structural schematic diagram of a partial cross section of a display device provided by an embodiment of the disclosure.
Figure 5:
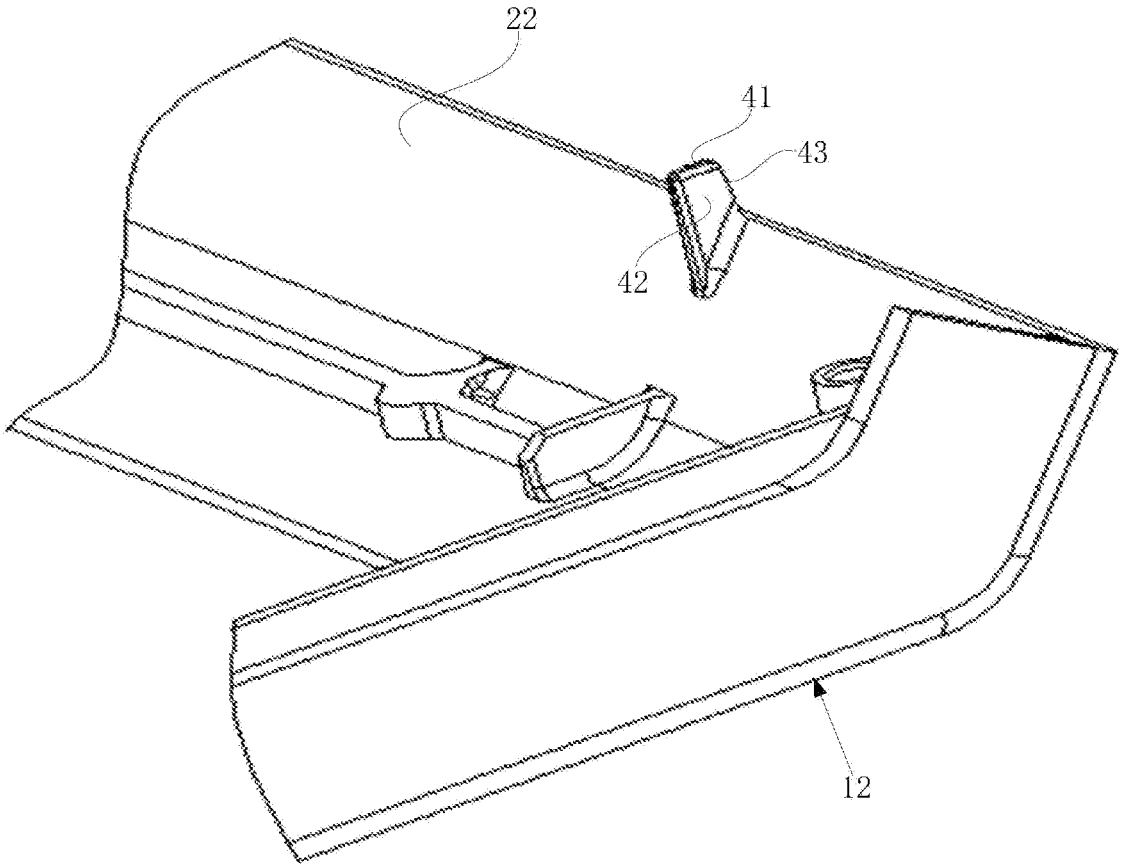
FIG. 5 is a partial structural schematic diagram of a second front frame of a display device provided by an embodiment of the disclosure.

As shown in FIGS. 4 and 5, based on the above embodiments, the first positioning stud 40 can be a cuboid, and optionally, the first positioning stud 40 includes: a top surface 41 far from the surface of the bottom border 22 of the second front frame 12, two first lateral surfaces 42 arranged along the extending direction of the bottom border 22 of the second front frame 12, and a second lateral surface 43 close to the bottom side of the bottom border 22; thus the splicing and positioning between two front frames can be implemented by limiting all the surfaces of the first positioning stud 40 via the first positioning boss 30.

Figure 6:
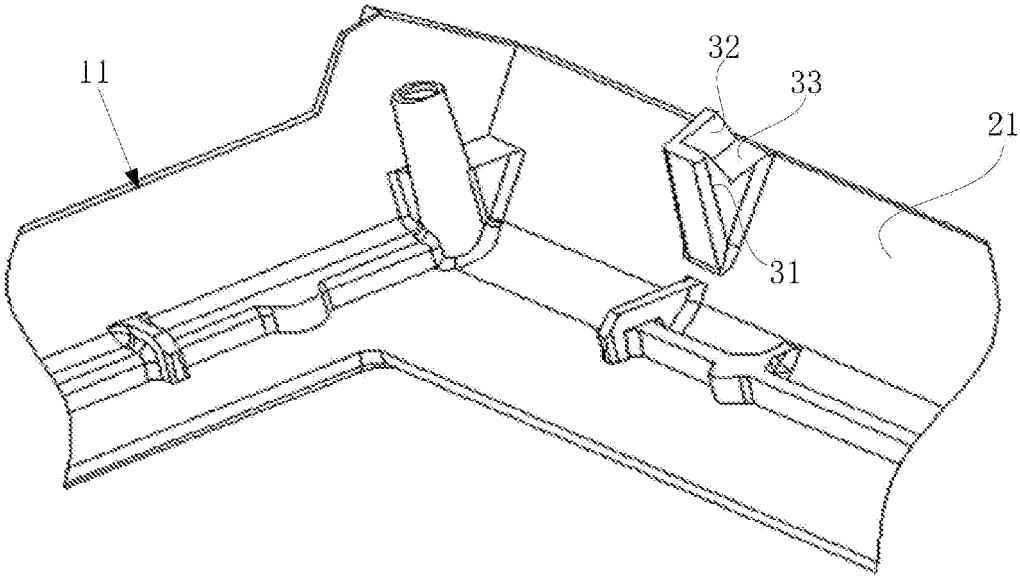
FIG. 6 is a partial structural schematic diagram of a first front frame of a display device provided by an embodiment of the disclosure.

As shown in FIGS. 4 to 6, based on the above embodiments, further, the first positioning boss 30 can include an inner blocking surface 31 for correspondingly contacting the top surface 41 of the first positioning stud 40, a lateral blocking surface 32 for correspondingly contacting one of the first lateral surfaces 42 of the first positioning stud 40, and a lap joint surface 33 for correspondingly contacting the second lateral surface 43 of the first positioning stud 40.

Optionally, the structure sizes of the positioning boss 3 and the positioning stud 4 need to meet the event that all the surfaces of the first front frame 11 and the second front frame 12 can be contacted and matched correspondingly after the splicing and alignment of the first front frame 11 and the second front frame 12; and in a practical application, a certain matching tolerance is allowed, for example, there is a gap of about 0.5 mm.

Optionally, the inner blocking surface 31, the lateral blocking surface 32 and the lap joint surface 33 can be connected to be a semi-enclosed structure. Of course, they can also be independent from each other and not connected.

Optionally, the heights of the lateral blocking surface 32 and the inner blocking surface 31 with respect to the bottom border 21 can be same, where the height can be about 4 mm to 5 mm; the lap joint surface 33 can be perpendicular to the inner blocking surface 31, and optionally, there can be a certain included angle between the surfaces of the lap joint surface 33 and the bottom border 21, and optionally, the width of the lap joint surface 33 can be about 5 mm to 6 mm.

For the display device provided by the embodiments of the disclosure, when the first and second display screens are installed, firstly the first positioning stud 40 on the second front frame 12 is plugged into the first positioning boss 30 on the first front frame 11 and optionally the second lateral surface 43 of the first positioning stud 40 is jointed with the lap joint surface 33 of the first positioning boss 30, and subsequently two front frames are pushed to make the first positioning stud 40 slide along the first positioning boss 30, until the top surface 41 of the first positioning stud 40 contacts with the inner blocking surface 31 of the first positioning boss 30 while the first lateral surface 42 of the first positioning stud 40 contacts with the lateral blocking surface 32 of the first positioning boss 30, to thereby implement the plugging of the first positioning stud 40 and the first positioning boss 30, i.e., accomplish the accurate splicing. At this time, since the first positioning stud 40 and the first positioning boss 30 limit each other, the misalignment of the first front frame 11 and the second front frame 12 in the up and down, left and right, and front and rear directions can be prevented to thereby ensure the splicing precision of the display screens, and the continuous adjustment actions due to the misalignment of the display screens in the installation process can be avoided to increase the installation efficiency greatly.

Furthermore, in the display device provided by the embodiment, since the positioning boss 3 and the positioning stud 4 have no reversing structure and the draft direction thereof is same as the draft direction of the front frame structure, the mould opening difficulty is lower, and thus it is very beneficial to the molding preparation of the front frame.

On basis of all the above embodiments, the front frames of two display screens can further be provided with a second pair of positioning boss and positioning stud structure, so as to make the plugging and positioning between the two display screens more accurate and stable.

Figure 3:
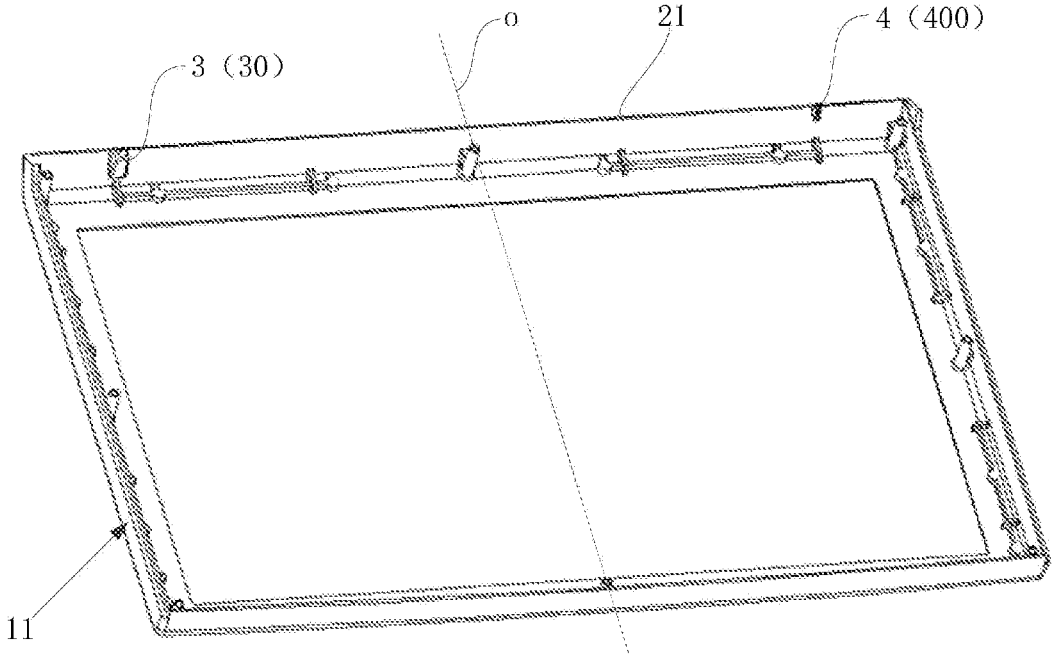
FIG. 3 is a structural schematic diagram of a first front frame of a display device provided by an embodiment of the disclosure.

For example, as shown in FIG. 3, the bottom border of the second front frame can be provided with a second positioning boss, and the bottom border 21 of the first front frame 11 is provided with a second positioning stud 400 which matches with the second positioning boss by plugging.

On basis of the above embodiments, as shown in FIG. 3, the first positioning boss 30 and the second positioning stud 400 are arranged symmetrically with respect to the center line o of the first front frame 11; and accordingly, the second positioning boss and the first positioning stud are arranged symmetrically with respect to the center line of the second front frame. With such arrangement, on the one hand, it can be ensured that the accurate alignment can be performed between the positioning stud at one side and the positioning boss at the other side when the borders at all the sides of the two front frames are spliced and aligned; and on the other hand, two plugging positions can be symmetrized, and thus the positioning can be more accurate and reliable.

As shown in FIGS. 1 to 4, on basis of the above embodiments, further the structures of the first front frame 11 and the second front frame 12 can be identical, that is, the plugging and matching structure of the second positioning boss and the second positioning stud 400 is identical to that of the first positioning boss 30 and the first positioning stud 40. At this time, on the one hand, it can be beneficial to the quantity production of the front frames; and on the other hand, two front frames are arranged symmetrically after splicing, that is, all the blocking surfaces of the first positioning boss 30 and all the blocking surfaces of the second positioning boss are symmetric with respect to the display screen center, to thereby facilitate the implementation of the fast plugging and positioning.

Of course, the number of the positioning bosses 3 and the positioning studs 4 on each front frame can be increased and decreased according to the actual length size of the front frame of the display screen. At this time, as shown in FIG. 3, there is only a need to ensure that the positioning bosses 3 and the positioning studs 4 on each front frame are symmetric with respect to the center line o of the front frame.

As shown in FIGS. 1 to 3, 5 and 6, on basis of all the above embodiments, both the first front frame 11 and the second front frame 12 can be molded by a mould; the production process is simple and the production efficiency is high.

Figure 2:
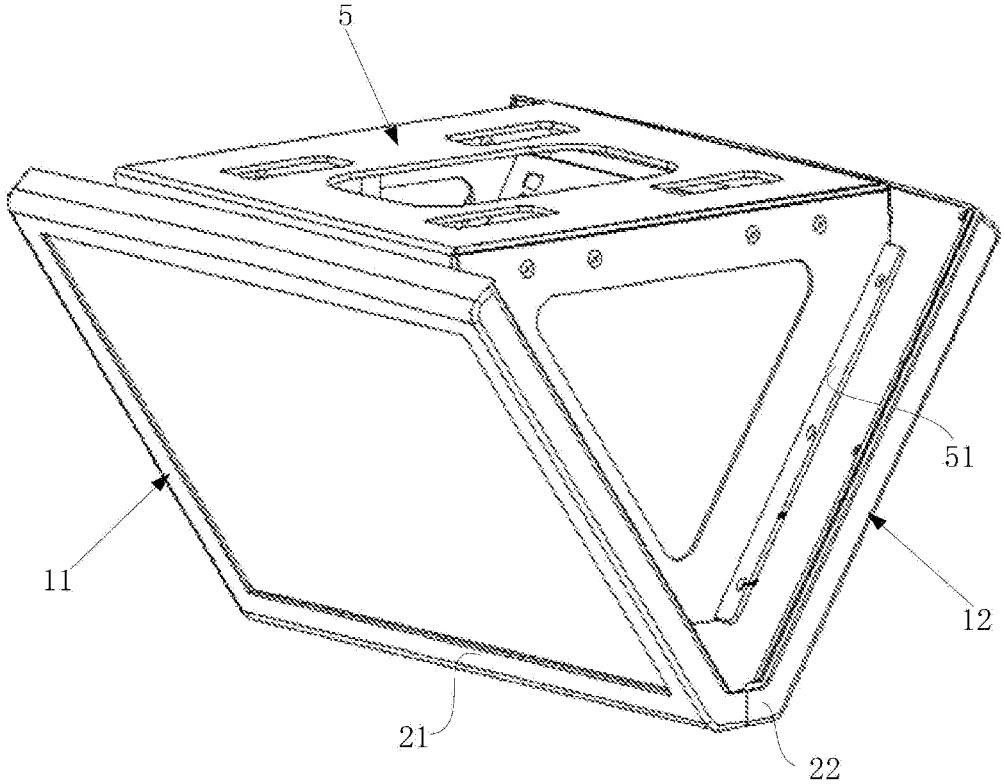
FIG. 2 is a structural schematic diagram of a display device provided by another embodiment of the disclosure.

As shown in FIGS. 1 and 2, on basis of all the above embodiments, the display device provided by the embodiment of the disclosure can further include a triangular fixed mount 5, and optionally, the triangular fixed mount 5 is located between the first and second display screens and fixedly connected with the first and second display screens respectively.

As shown in FIGS. 1 and 2, on basis of the above embodiments, the triangular fixed mount 5 can be provided with a first fixed edge parallel to the back panel of the first display screen and a second fixed edge 51 parallel to the back panel of the second display screen; further, the back panel of the first display screen is fixed to the first fixed edge by a fastener; and the back panel of the second display screen is fixed to the second fixed edge 51 by a fastener, where the above-mentioned fasteners can be bolts or screws or the like.

As shown in FIG. 1, on basis of all the above embodiments, the display device provided by the embodiment of the disclosure can further include two side baffles 6 arranged between the first and second display screens and located at two sides of the triangular fixed mount 5 respectively, where these two side baffles 6 can shield the structure, such as the triangular fixed mount 5, between the back panels of two display screens to thereby improve the appearance of the whole display device.

As shown in FIG. 1, on basis of all the above embodiments, the display device provided by the embodiment of the disclosure can further include an installation roof 7, where the installation roof 7 is fixedly connected with the triangular fixed mount 5 and used to fix the whole display device onto the ceiling or another structure.

Evidently those skilled in the art can make various modifications and variations to the embodiments of the disclosure without departing from the spirit and scope of the disclosure. Thus the disclosure is also intended to encompass these modifications and variations to the disclosure as long as these modifications and variations come into the scope of the claims of the disclosure and their equivalents.

What is claimed is:

1. A display device, comprises a first display screen and a second display screen arranged at a certain included angle back to back, wherein the first display screen is provided with a first front frame, the second display screen is provided with a second front frame, and a bottom border of the first front frame is spliced with a bottom border of the second front frame; wherein:

the bottom border of the first front frame is provided with a first positioning boss, the bottom border of the second front frame is provided with a first positioning stud, and the first positioning boss matches with the first positioning stud by plugging;

wherein the first positioning boss is provided on an inner side of the first front frame; and the first positioning stud is provided on an inner side of the second front frame; the inner side of the first front frame faces to the first display screen; the inner side of the second front frame faces to the second display screen; the first positioning stud is a cuboid and comprises a top surface far from a bottom border surface of the second front frame, two first lateral surfaces arranged along an extending direction of the bottom border of the second front frame, and a second lateral surface close to a bottom side of the bottom border of the second front frame.

2. The display device according to claim 1, wherein the first positioning boss comprises an inner blocking surface for correspondingly contacting a top surface of the first positioning stud, a lateral blocking surface for correspondingly contacting one of first lateral surfaces of the first positioning stud, and a lap joint surface for correspondingly contacting a second lateral surface of the first positioning stud.

3. The display device according to claim 1, wherein the bottom border of the second front frame is provided with a second positioning boss, the bottom border of the first front frame is provided with a second positioning stud, and the second positioning boss matches with the second positioning stud by plugging.

4. The display device according to claim 3, wherein, the first positioning boss and the second positioning stud are arranged symmetrically with respect to a center line of the first front frame;

the second positioning boss and the first positioning stud are arranged symmetrically with respect to a center line of the second front frame.

5. The display device according to claim 3, wherein structures of the first and second front frames are same.

6. The display device according to claim 1, wherein the first and second front frames are molded by a mould.

7. The display device according to claim 1, wherein the display device further comprises a triangular fixed mount which is arranged between the first and second display screens and fixedly connected with the first and second display screens respectively.

8. The display device according to claim 7, wherein the triangular fixed mount is provided with a first fixed edge parallel to a back panel of the first display screen and a second fixed edge parallel to a back panel of the second display screen;

the back panel of the first display screen is fixed to the first fixed edge by a fastener; and the back panel of the second display screen is fixed to the second fixed edge by a fastener.

9. A display device, comprises a first display screen and a second display screen arranged at a certain included angle back to back, wherein the first display screen is provided with a first front frame, the second display screen is provided with a second front frame, and a bottom border of the first front frame is spliced with a bottom border of the second front frame; wherein:

the bottom border of the first front frame is provided with a first positioning boss, the bottom border of the second front frame is provided with a first positioning stud, and the first positioning boss matches with the first positioning stud by plugging;

wherein the first positioning boss is provided on an inner side of the first front frame; and the first positioning stud is provided on an inner side of the second front frame; the inner side of the first front frame faces to the first display screen; the inner side of the second front frame faces to the second display screen; wherein the first positioning boss comprises an inner blocking surface for correspondingly contacting a top surface of the first positioning stud, a lateral blocking surface for correspondingly contacting one of first lateral surfaces of the first positioning stud, and a lap joint surface for correspondingly contacting a second lateral surface of the first positioning stud.

10. The display device according to claim 9, wherein the bottom border of the second front frame is provided with a second positioning boss, the bottom border of the first front frame is provided with a second positioning stud, and the second positioning boss matches with the second positioning stud by plugging.

11. The display device according to claim 10, wherein, the first positioning boss and the second positioning stud are arranged symmetrically with respect to a center line of the first front frame;

the second positioning boss and the first positioning stud are arranged symmetrically with respect to a center line of the second front frame.

12. The display device according to claim 9, wherein structures of the first and second front frames are same.

13. The display device according to claim 9, wherein the first and second front frames are molded by a mould.

14. The display device according to claim 9, wherein the display device further comprises a triangular fixed mount which is arranged between the first and second display screens and fixedly connected with the first and second display screens respectively.

15. The display device according to claim 14, wherein the triangular fixed mount is provided with a first fixed edge parallel to a back panel of the first display screen and a second fixed edge parallel to a back panel of the second display screen;

the back panel of the first display screen is fixed to the first fixed edge by a fastener; and the back panel of the second display screen is fixed to the second fixed edge by a fastener.

* * * * *